US009858852B2

(12) United States Patent
Yoshinaga

(10) Patent No.: US 9,858,852 B2
(45) Date of Patent: Jan. 2, 2018

(54) DRIVING CIRCUIT, DISPLAY, AND METHOD OF DRIVING THE DISPLAY

(75) Inventor: Tomoro Yoshinaga, Kanagawa (JP)

(73) Assignee: Sony Corporation, Tokyo (JP)

( * ) Notice: Subject to any disclaimer, the term of this patent is extended or adjusted under 35 U.S.C. 154(b) by 676 days.

(21) Appl. No.: 13/567,666

(22) Filed: Aug. 6, 2012

(65) Prior Publication Data

US 2013/0050299 A1 Feb. 28, 2013

(30) Foreign Application Priority Data

Aug. 31, 2011 (JP) ..... 2011-189927

(51) Int. Cl.
*G09G 3/36* (2006.01)
*G09G 3/20* (2006.01)

(52) U.S. Cl.
CPC ..... *G09G 3/2022* (2013.01); *G09G 2310/027* (2013.01)

(58) Field of Classification Search
CPC ..... G09G 2310/027
See application file for complete search history.

(56) References Cited

U.S. PATENT DOCUMENTS 5,614,924 A * 3/1997 Numao ..... G09G 3/3607 345/89
6,429,833 B1 * 8/2002 Ryeom ..... G09G 3/2037 345/60
6,937,222 B2 * 8/2005 Numao ..... G09G 3/3258 345/82
2006/0164370 A1 * 7/2006 Park ..... G09G 3/3648 345/98

(Continued)

FOREIGN PATENT DOCUMENTS

JP H09-127906 A 5/1997
JP 2000-112426 A 4/2000

(Continued)

OTHER PUBLICATIONS

Japanese Office Action dated Jun. 2, 2015 for corresponding Japanese Application No. 2011-189927.

(Continued)

*Primary Examiner* — Jennifer Mehmood
*Assistant Examiner* — Carl Adams
(74) *Attorney, Agent, or Firm* — Michael Best & Friedrich LLP

(57) ABSTRACT

There is provided a driving circuit driving pixels each including an electro-optical device and a memory, in a display. The driving circuit includes: a dividing section dividing one frame period into subblocks composed of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of the pixel into an on state or an off state according to a corresponding bit in each of the subfields. On a subblock by subblock basis, the ON-OFF period control section selects scan lines whose number is less by one than a number of the subfields included in a relevant subblock, and again selects one of the selected scan lines during a same subblock period.

22 Claims, 7 Drawing Sheets

(56) References Cited

U.S. PATENT DOCUMENTS

| | | | | |
|---|---|---|---|---|
| 2008/0191977 | A1 | 8/2008 | Park et al. | |
| 2008/0239179 | A1* | 10/2008 | Kasai | G09G 3/3648 349/34 |
| 2010/0013802 | A1* | 1/2010 | Hosaka | G09G 3/204 345/204 |

FOREIGN PATENT DOCUMENTS

| | | | |
|---|---|---|---|
| JP | 2004-004501 | A | 1/2004 |
| JP | 2006-030946 | A | 2/2006 |
| JP | 2006-343609 | | 12/2006 |
| JP | 2008-058921 | A | 3/2008 |

OTHER PUBLICATIONS

Japanese Office Action dated Aug. 25, 2015 for corresponding Japanese Application No. 2011-189927.

* cited by examiner

| ARRANGEMENT | BIT | WIDTH |
|---|---|---|
| 1 | 1 | 0.5 |
| 2 | 2 | 1 |
| 3 | 4 | 3.5 |
| 4 | 3 | 2 |

| ARRANGEMENT | BIT | WIDTH |
|---|---|---|
| 1 | 2 | 0.5 |
| 2 | 1 | 0.25 |
| 3 | 5 | 3.5 |
| 4 | 4 | 2 |
| 5 | 3 | 1 |

| ARRANGEMENT | BIT | WIDTH |
|---|---|---|
| 1 | 1 | 1 |
| 2 | 2 | 2 |
| 3 | 3 | 4 |

FIG. 10

DRIVING CIRCUIT, DISPLAY, AND METHOD OF DRIVING THE DISPLAY

BACKGROUND

The present technology relates to a driving circuit that performs gray-scale display by pulse-width modulation (PWM), and a display including the driving circuit. In addition, the present technology relates to a method of driving the above-mentioned display.

In digital displays that perform gray-scale display by PWM, a gray-scale display method as illustrated in FIG. 5 is used in an exemplary case of 5 bits (32 gray-scale levels), for example. Specifically, as illustrated in FIG. 5, with 1 bit data of several ms width taken as a unit for example, five pieces of data having a period length ratio of 1:2:4:8:16 are prepared, and 32 gray-scale levels are expressed by a combination of these five pieces of data.

FIG. 6 shows a relationship between signal data of sequential scanning and selection pulses applied to scan lines in known general digital driving. FIG. 6 shows a case of three scan lines for convenience of description. As is clear from FIG. 6, in a known general digital display, one frame period (1F) is divided into subfields SF1 to SF5 corresponding to respective bits (in this example, a first bit to a fifth bit) of gray-scale data, and having period lengths commensurate with the weights of the corresponding bits. In this configuration, an electro-optical device of a pixel is turned on or off according to the corresponding bit in each of the subfields SF1 to SF5, and thus a ratio of ON period or OFF period to 1F is stepwisely controlled. Further, data is written in pixels through scan lines by line-sequential scanning in each of the subfields SF1 to SF5. It is to be noted that, information on the above-mentioned digital driving is described in Japanese Unexamined Patent Application Publication No. 2006-343609 and the like.

SUMMARY

However, since the transfer rate of the signal data is limited by the transfer rate of the minimum bit (first bit) in the above-mentioned method for gray-scale display, it is not easy to increase the number of gray-scale levels. In this respect, in Japanese Unexamined Patent Application Publication No. 2006-343609, for example, it is proposed that a plurality of subfields is put into one subblock and one frame period is divided into a plurality of subblocks, and scan lines are scanned in an interlaced manner on a subblock by subblock basis.

FIG. 9 schematically shows an example of the above-mentioned interlaced scanning. As illustrated in (A) of FIG. 9, one frame period is divided into seven subblocks SB1 to SB7, and each of the subblocks SB1 to SB7 is composed of three subfields illustrated in FIG. 10. As illustrated in (B) to (H) of FIG. 9, the scan lines 1 to 7 are scanned in an interlaced manner on a subblock by subblock basis. Further, when the scan lines 1 to 7 are scanned in an interlaced manner in all of the subblocks SB1 to SB7, pixels connected to the scan lines 1 to 7 are turned on or off according to bits corresponding to respective subfields.

In the gray-scale display method in FIG. 9, the transfer rate is uniform in the subblocks, and besides, the transfer rate may be considerably reduced in comparison to known gray-scale display methods. Therefore, since the number of gray-scale levels is not limited by the transfer rate of the minimum bit, it is possible to readily increase the number of gray-scale levels. However, in the gray-scale display method in FIG. 9, the number of gray-scale levels is restricted by the number of scan lines. Therefore, it may be possible that the number of scan lines has to be increased in order to increase the number of gray-scale levels.

It is desirable to provide a driving circuit which allows the number of gray-scale levels to be increased without increasing the number of scan lines and a display including the driving circuit. In addition, it is also desirable to provide a method of driving a display which allows the number of gray-scale levels to be increased without increasing the number of scan lines.

According to an embodiment of the present technology, there is provided a driving circuit configured to drive pixels each including an electro-optical device and a memory in a display in which the pixels are disposed in matrix and a scan line is provided for each of pixel rows. The driving circuit includes: a dividing section dividing one frame period into a plurality of subblocks composed of a plurality of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of the pixel into an on state or an off state according to a corresponding bit in each of the subfields. On a subblock by subblock basis, the ON-OFF period control section selects scan lines whose number is less by one than a number of the subfields included in a relevant subblock, and again selects one of the selected scan lines during a same subblock period.

According to an embodiment of the present technology, there is provided a display including a display region in which pixels each including an electro-optical device and a memory are disposed in matrix and a scan line is provided for each of pixel rows, and a driving circuit configured to drive the pixels. The driving circuit includes: a dividing section dividing one frame period into a plurality of subblocks composed of a plurality of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of the pixel into an on state or an off state according to a corresponding bit in each of the subfields. On a subblock by subblock basis, the ON-OFF period control section selects scan lines whose number is less by one than a number of the subfields included in a relevant subblock, and again selects one of the selected scan lines during a same subblock period.

According to an embodiment of the present technology, there is provided a method of driving a display in which pixels each including an electro-optical device and a memory are disposed in matrix and a scan line is provided for each of pixel rows. The method includes: dividing one frame period into a plurality of subblocks composed of a plurality of subfields, the subfields corresponding to respective bits of gray-scale data and having period lengths commensurate with weights of the corresponding bits; and controlling a ratio of an ON period or an OFF period to one frame period by bringing an electro-optical device of the pixel into an on state or an off state according to a corresponding bit in each of the subfields. When the ratio of the ON period or the OFF period to one frame period is controlled, scan lines whose number is less by one than a number of the subfields included in a relevant subblock are selected, and one of the selected scan lines is again selected during a same subblock period on a subblock by subblock basis.

In the driving circuit, the display, and the method of driving the display according to the embodiments of the present technology, the scan lines whose number is less by one than the number of the subfields included in the relevant subblock are selected, and one of the selected scan lines is again selected in the same subblock period on a subblock by subblock basis. This configuration enables switching to ON-OFF driving commensurate with a bit different from a bit corresponding to a subfield immediately prior to the reselection, with a period length shorter than that of the subblock.

According to the driving circuit, the display, and the method of driving the display according to the embodiments of the present technology, since switching to ON-OFF driving commensurate with a bit different from a bit corresponding to a subfield immediately prior to the reselection is enabled with a period length shorter than that of the subblock, it is possible to increase the number of gray-scale levels without increasing the number of scan lines.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 10 is a view showing an exemplary configuration of subfields of FIG. 9.

DETAILED DESCRIPTION

Referring to the figures, an embodiment of the present technology will be described in detail. Description will be given in the following order.

1. Embodiment (Display)
2. Modification (Display)

(1. Embodiment)

[Configuration]

Figure 1:
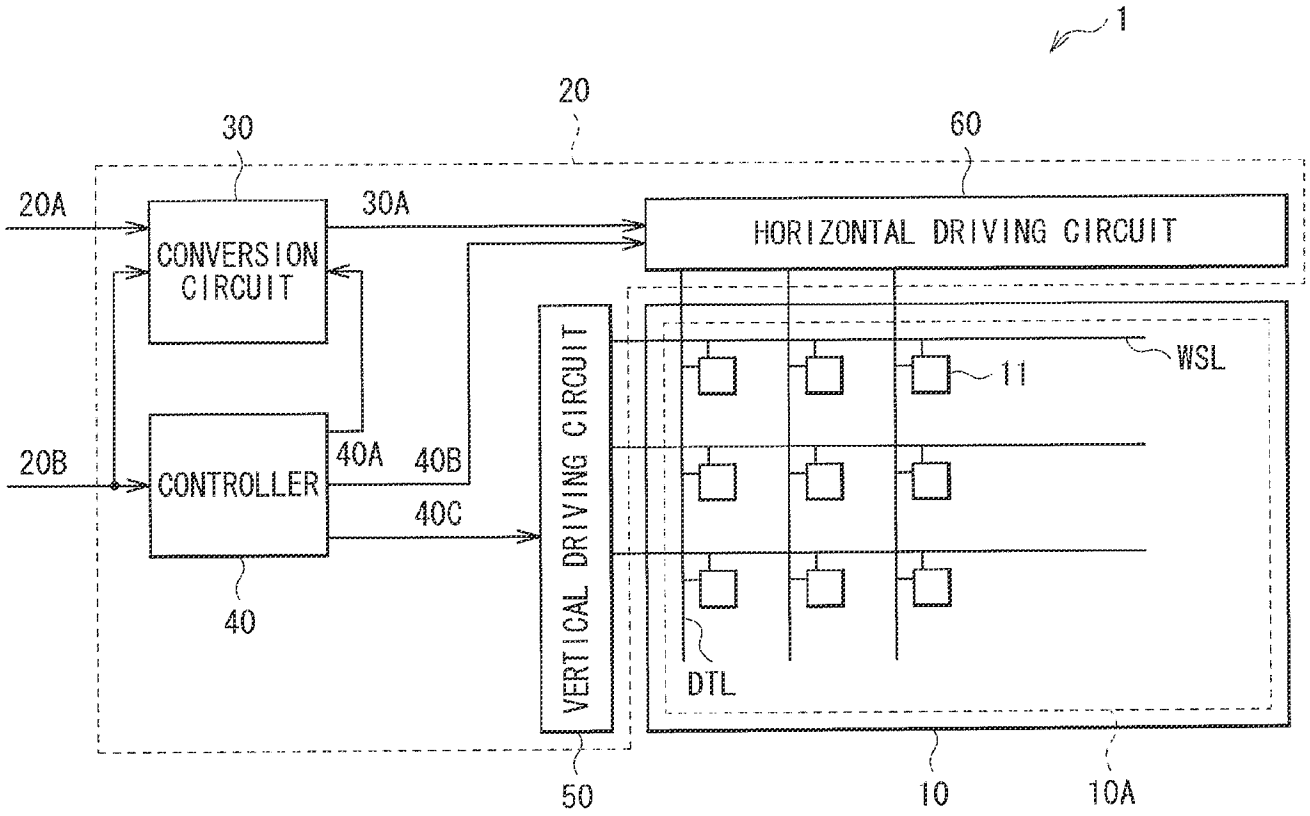
FIG. 1 is a schematic view of a display according to an embodiment of the present technology.

FIG. 1 shows a schematic configuration of a display 1 according to an embodiment of the present technology. The display 1 includes a display panel 10, and a peripheral circuit 20 that drives the display panel 10.

(Display Panel 10)

The display panel 10 includes a plurality of scan lines WSL extending in a row direction, a plurality of data lines DTL extending in a column direction, and a plurality of pixels 11 disposed at locations corresponding to crossing points between the scan lines WSL and the data lines DTL. The pixels 11 in the display panel 10 are two-dimensionally disposed in a row direction and a column direction all over a pixel region 10A of the display panel 10. Each pixel 11 corresponds to a dot as a minimum unit configuring a screen on the display panel 10. In the case where the display panel 10 is a color display panel, each pixel 11 corresponds to a sub pixel that emits single color light of red, green, or blue, for example, whereas in the case where the display panel 10 is a monochrome display panel, each pixel 11 corresponds to a pixel that emits monochromatic light (white light, for example).

Although not shown in the figure, each of the pixels 11 is a pixel including an electro-optical device and a memory. Examples of the electro-optical device include a liquid crystal cell and an organic EL (Electro Luminescence) cell. Examples of the memory include SRAM (Static Random Access Memories) and DRAM (Dynamic Random Access Memories). When a corresponding one of the scan lines WSL is selected, the pixel 11 is brought into a light-emitting state or a light-off state according to writing of signal data (bit) supplied to a corresponding data line DTL, and thereafter, even after the selected scan line WSL is brought into a non-selected state, the light-emitting state or the light-off state according to the writing is continued. Therefore, the peripheral circuit 20 controls the ratio of a period within which the pixel 11 is in the light-emitting state (lighting period), or a period within which the pixel 11 is in the light-off state (light-off period) to one frame period, thereby realizing a gray-scale display.

Figure 5:
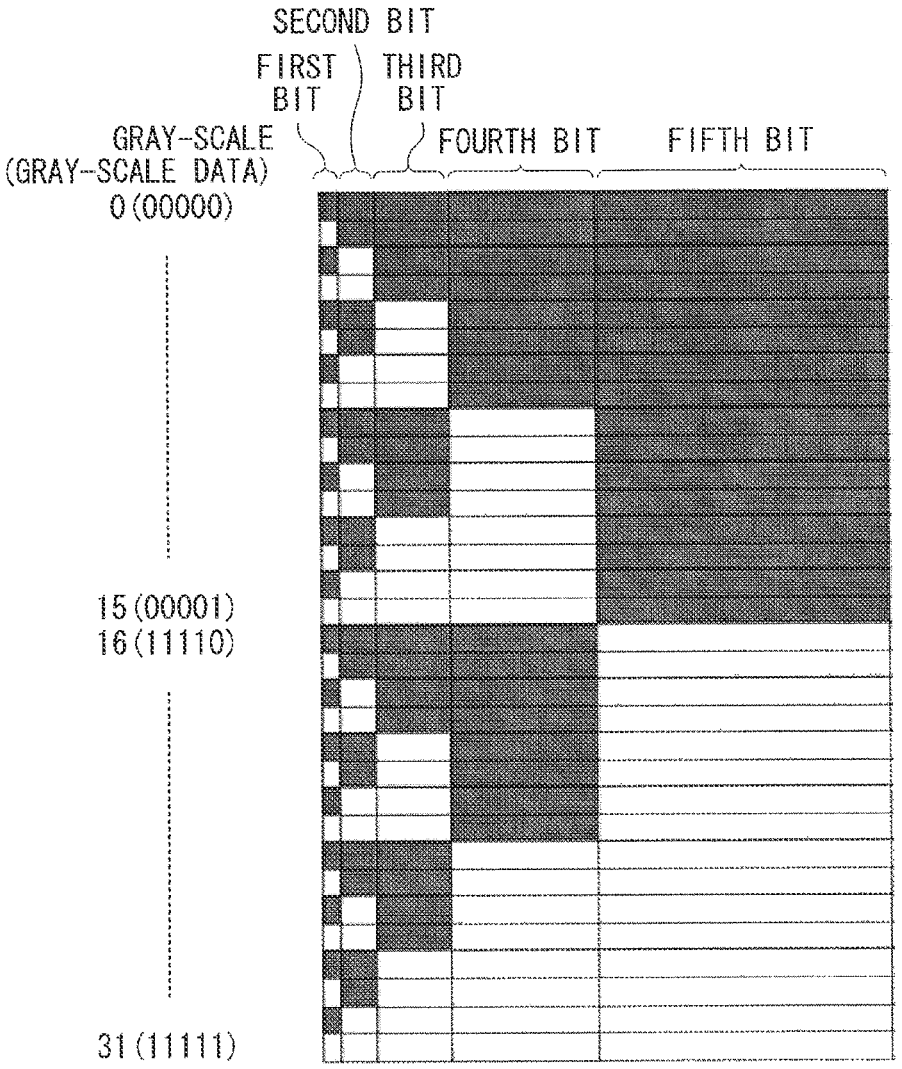
FIG. 5 is a schematic view showing an example of known gray-scale data.

There is a concept of "subfield" as a unit of a lighting period or a light-off period of the pixels 11. "Subfield" refers to a unit which corresponds to each bit of gray-scale data defining the gray-scale of the pixels 11, and has a period length commensurate with the weight of the corresponding bit. Generally, in an exemplary case where 32 gray-scale levels are to be expressed by gray-scale data of 5 bits, as illustrated in FIG. 5 for example, with 1 bit data of several ms width taken as a unit for example, five pieces of data having a period length ratio of 1:2:4:8:16 are prepared, and 32 gray-scale levels are expressed by a combination of these five pieces of data. According to the above-mentioned gray-scale display method, as illustrated in (A) of FIG. 6, signal data is defined by subfields SF1 to SF5 corresponding to respective bits of gray-scale data (in this example, a first bit to a fifth bit), and having period lengths commensurate with the weights of the corresponding bits.

In the present embodiment, a gray-scale display method is applied in which a plurality of the subfields are put into one subblock, one frame period is divided by a plurality of the subblocks, and scan lines are scanned in an interlaced manner on a subblock by subblock basis.

Figures 2, 3:
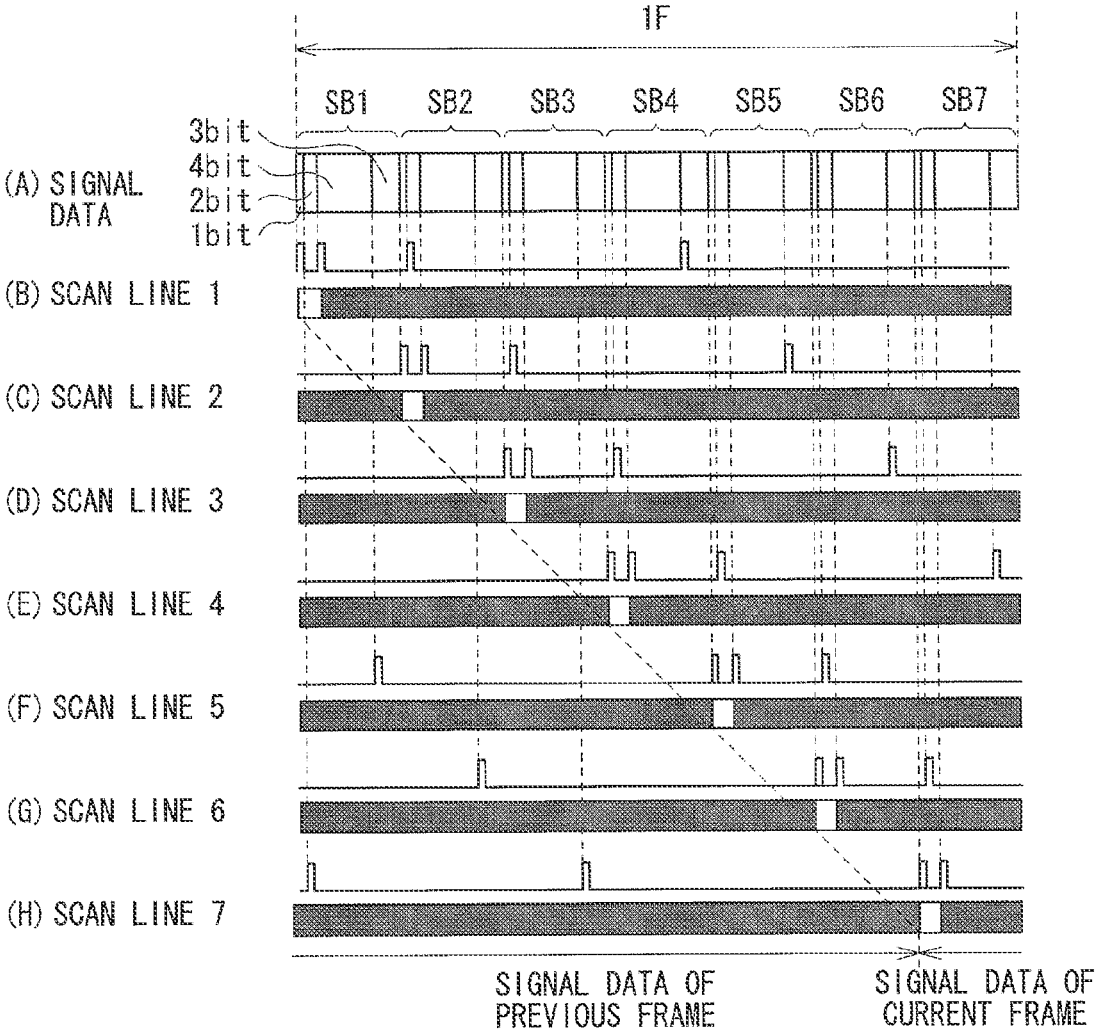
FIG. 2 is a schematic view showing an example of signal data and an example of selection pulses, in one frame period.
FIG. 3 is a view showing an exemplary configuration of subfields of FIG. 2.

FIG. 2 schematically shows an example of the above-mentioned gray-scale display method. As illustrated in (A) of FIG. 2, one frame period is divided into seven subblocks SB1 to SB7, and each of the subblocks SB1 to SB7 is composed of four subfields illustrated in FIG. 3. The four subfields correspond to respective bits of gray-scale data, and have period lengths commensurate with the weights of the corresponding bits. Specifically, the first subfield corresponds to a first bit of the gray-scale data, and the period length of the first subfield corresponds to the weight of the first bit, that is, 0.5. The second subfield corresponds to a second bit of the gray-scale data, and the period length of the second subfield corresponds to the weight of the second bit, that is, 1. The third subfield corresponds to a fourth bit of the gray-scale data, and the period length of the third subfield corresponds to the weight of the fourth bit, that is, 3.5. The fourth subfield corresponds to a third bit of the gray-scale data, and the period length of the fourth subfield corresponds to the weight of the third bit, that is, 2. In each of the subblocks SB1 to SB7, the subfield with the greatest width is placed in the third position, not the fourth position.

As illustrated in (B) to (H) of FIG. 2, the scan lines 1 to 7 are scanned in an interlaced manner on a subblock by subblock basis. Further, each of the scan lines 1 to 7 are scanned in an interlaced manner in all of the subblocks SB1 to SB7, and thus pixels connected to the scan lines 1 to 7 are turned on or off according to the bits corresponding to respective subfields. In the scanning using the subblocks SB1 to SB7, in each of the subblocks SB1 to SB7, scan lines whose number is less by one than the number of the subfields included in the relevant subblock are selected, and one of the selected scan lines is again selected in the same subblock period. The speed of the interlaced scanning depends on the number of the scan lines to be selected, and is uniform in the subblocks SB1 to SB7. In addition, typically, the timing of the reselection of the scan line coincides (or is in synchronization) with the start timing of the subfield having the greatest width.

For example, in the subblock SB1, three scan lines 1, 5, and 7 are selected, and, from between the selected three scan lines 1, 5, and 7, the scan line 1 is again selected during the subblock SB1 period. In addition, for example, in the subblock SB2, three scan lines 1, 2, and 6 are selected, and, from between the selected three scan lines 1, 2, and 6, the scan line 2 is again selected during the subblock SB2 period. In addition, for example, in the subblock SB3, three scan lines 2, 3, and 7 are selected, and, from between the selected three scan lines 2, 3, and 7, the scan line 3 is again selected during the subblock SB3 period. In addition, for example, in the subblock SB4, three scan lines 1, 3, and 4 are selected, and, from between the selected three scan lines 1, 3, and 4, the scan line 4 is again selected during the subblock SB4 period. In addition, for example, in the subblock SB5, three scan lines 2, 4, and 5 are selected, and, from between the selected three scan lines 2, 4, and 5, the scan line 5 is again selected during the subblock SB5 period. In addition, for example, in the subblock SB6, three scan lines 3, 5, and 6 are selected, and, from between the selected three scan lines 3, 5, and 6, the scan line 6 is again selected during the subblock SB6 period. In addition, for example, in the subblock SB7, three scan lines 4, 6, and 7 are selected, and, from between the selected three scan lines 4, 6, and 7, the scan line 7 is again selected during the subblock SB7 period.

In each of the subblocks SB1 to SB7, the timing of the reselection of the scan line coincides (or is in synchronization) with the start timing of the third subfield. In addition, in each of the subblocks SB1 to SB7, the scan line to be reselected is selected first and thereafter selected again third. In this case, when the scan line is selected again during the same subblock period, a bit different from the initial bit is written in the pixel. In other words, as illustrated in (B) to (H) of FIG. 2, a shortest period of an interval during which the ON-OFF driving is carried out by the reselection is equal to the sum of the period lengths of the first subfield and the second subfield. It is to be noted that, while the bit in the interval during which the ON-OFF driving is carried out by the reselection is typically 1 (white) in (B) to (H) of FIG. 2, the bit may also be 0 (black), although not shown in the figure.

Writing of signal data of the current frame in each pixel row is started in response to the sequential selection of each scan line in the first period of each of the subblocks SB1 to SB7. For example, in the subblock SB1, when the scan lines are selected in an interlaced manner in the order of 1, 7, 1, 5, the signal data of the current frame is written in response to the selection of the scan line 1, and the signal data of the previous frame is written in response to the selection of the scan lines 5 and 7.

(Peripheral Circuit 20)

Next, a configuration of the peripheral circuit 20 is described. The peripheral circuit 20 includes, as illustrated in FIG. 1, a conversion circuit 30, a controller 40, a vertical driving circuit 50, and a horizontal driving circuit 60, for example.

The controller 40 generates, from a synchronization signal 20B supplied from a higher device not shown in the figure, control signals 40A, 40B, and 40C intended to control operation timings of the conversion circuit 30, the vertical driving circuit 50, and the horizontal driving circuit 60. Examples of the synchronization signal 20B include a vertical synchronization signal, a horizontal synchronization signal, and a dot clock signal. Examples of the control signals 40A, 40B, and 40C include a clock signal, a latch signal, a frame start signal, and a subfield start signal.

Figure 4:
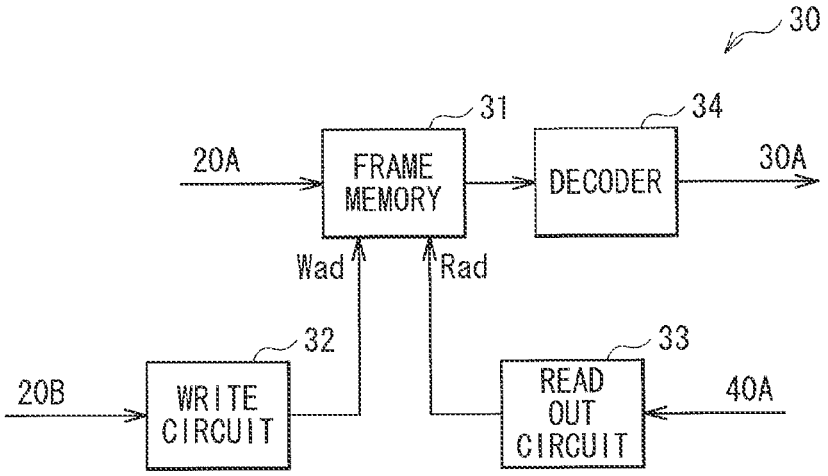
FIG. 4 is a schematic view of a conversion circuit illustrated in FIG. 1.

As illustrated in FIG. 4, the conversion circuit 30 includes a frame memory 31, a write circuit 32, a read-out circuit 33, and a decoder 34, for example. The frame memory 31 is a memory for image display having storage capacity at least greater than the resolution of the display region 10A, and is capable of storing row addresses, column addresses, and gray-scale data of the pixels 11 associated with the row addresses and the column addresses, for example. The write circuit 32 utilizes the synchronization signal 20B to generate a write address Wad of a video signal 20A, and, in synchronization with the synchronization signal 20B, outputs the write address Wad to the frame memory 31. The write address Wad includes a row address and a column address, for example. Based on the control signal 40A, the read-out circuit 33 generates a read-out address Rad, and outputs the read-out address Rad to the frame memory 31. The decoder 34 outputs gray-scale data outputted from the frame memory 31 as signal data 30A.

Based on address data specified by the control signal 40C, the vertical driving circuit 50 outputs, to the scan line WSL, a scan pulse intended to select each pixel 11 on a row by row basis. As illustrated in (B) to (H) of FIG. 2, the vertical driving circuit 50 divides one frame period into seven subblocks SB1 to SB7, and divides each of the subblocks SB1 to SB7 into four subfields illustrated in FIG. 3, for example. As illustrated in (B) to (H) of FIG. 2, the vertical driving circuit 50 scans each of the scan lines 1 to 7 in an interlaced manner on a subblock by subblock basis, for example. Upon the scanning using the subblocks SB1 to SB7, in each of the subblocks SB1 to SB7, the vertical driving circuit 50 selects the scan lines whose number is less by one than the number of the subfields included in the relevant subblock, and one of the selected scan lines is again selected during the same subblock period.

The vertical driving circuit 50 matches (or synchronizes) the timing of the reselection of the scan line with the start timing of the third subfield in each of the subblocks SB1 to SB7. In addition, in each of the subblocks SB1 to SB7, the vertical driving circuit 50 selects the scan line to be reselected first, and thereafter, reselect the same scan line third.

Based on the control signal 40B and the signal data 30A, the horizontal driving circuit 60 brings the electro-optical devices of the pixels 11 into an on state or an off state according to the corresponding bit in each of the subfields, and thus controls a ratio of ON period or OFF period to 1F stepwisely. As illustrated in (A) of FIG. 2, the horizontal driving circuit 60 outputs, to the data line DTL, the gray-scale data corresponding to each subfield of each of the subblocks SB1 to SB7, for example. When the vertical driving circuit 50 again selects the scan line during the same subblock period, the horizontal driving circuit 60 writes a bit different from the initial bit in the pixel through the data line DTL.

[Effect]

Next, in comparison with known general digital driving, an effect of the display 1 according to the present embodiment is described.

In digital displays that perform gray-scale display by PWM, a gray-scale display method as illustrated in FIG. 5 is used in an exemplary case of 5 bits (32 gray-scale levels), for example. Specifically, as illustrated in FIG. 5, with 1 bit data of several ms width taken as a unit for example, five pieces of data having a period length ratio of 1:2:4:8:16 are prepared, and 32 gray-scale levels are expressed by a combination of these five pieces of data.

Figure 6:
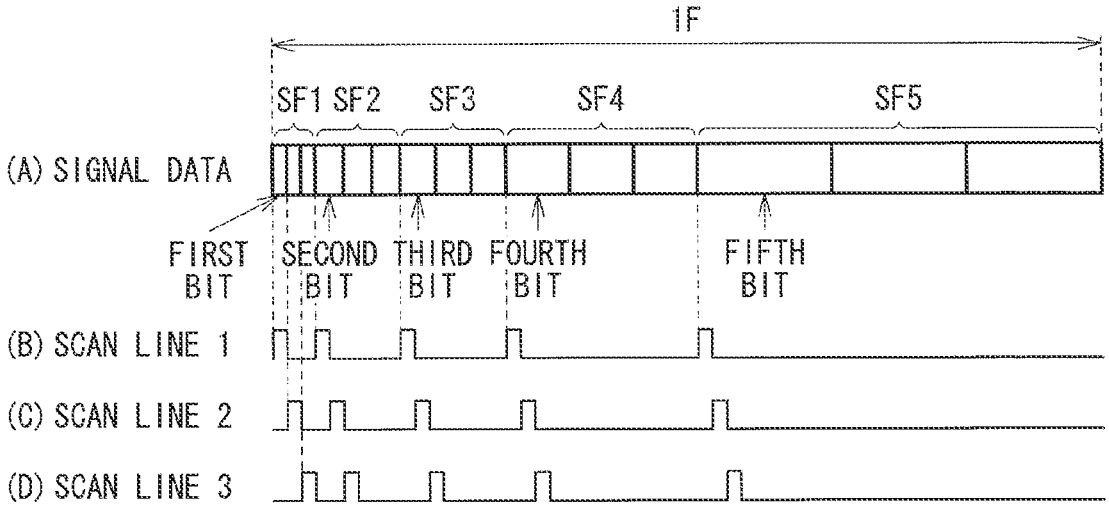
FIG. 6 is a schematic view showing a known example of signal data and a known example of selection pulses, in one frame period.

FIG. 6 shows a relationship between signal data of sequential scanning and selection pulses applied to scan lines in known general digital driving. FIG. 6 shows a case of three scan lines for convenience of description. As is clear from FIG. 6, in a known general digital display, one frame period (1F) is divided into subfields SF1 to SF5 corresponding to respective bits (in this example, a first bit to a fifth bit) of gray-scale data, and having period lengths commensurate with the weights of the corresponding bits. In this configuration, an electro-optical device of a pixel is turned on or off according to the corresponding bit in each of the subfields SF1 to SF5, and thus a ratio of ON period or OFF period to 1F is stepwisely controlled. Further, data is written in pixels through scan lines by line-sequential scanning in each of the subfields SF1 to SF5.

However, since the transfer rate of the signal data is limited by the transfer rate of the minimum bit (first bit) in the above-mentioned method for gray-scale display, it is not easy to increase the number of gray-scale levels. In this respect, for example, it is proposed that a plurality of subfields is put into one subblock and one frame period is divided into a plurality of subblocks, and scan lines are scanned in an interlaced manner on a subblock by subblock basis.

Figures 8, 9:
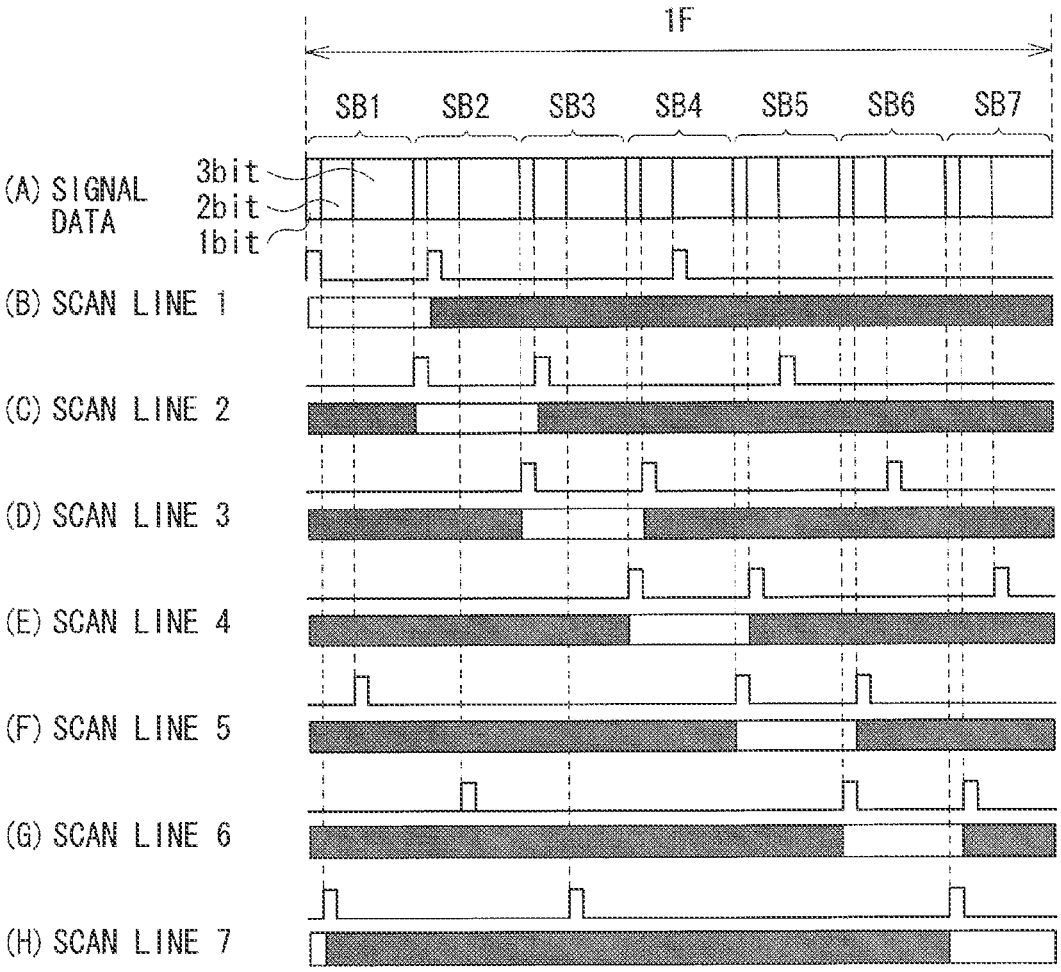
FIG. 8 is a view showing an exemplary configuration of subfields of FIG. 7.
FIG. 9 is a schematic view showing a known example of signal data and a known example of selection pulses, in one frame period.

FIG. 9 schematically shows an example of the above-mentioned interlaced scanning. As illustrated in (A) of FIG. 9, one frame period is divided into seven subblocks SB1 to SB7, and each of the subblocks SB1 to SB7 is composed of three subfields illustrated in FIG. 10. As illustrated in (B) to (H) of FIG. 9, the scan lines 1 to 7 are scanned in an interlaced manner on a subblock by subblock basis. Further, when the scan lines 1 to 7 are scanned in an interlaced manner in all of the subblocks SB1 to SB7, pixels connected to the scan lines 1 to 7 are turned on or off according to bits corresponding to respective subfields.

In the gray-scale display method in FIG. 9, the transfer rate is uniform in the subblocks, and besides, the transfer rate may be considerably reduced in comparison to known gray-scale display methods. Therefore, since the number of gray-scale levels is not limited by the transfer rate of the minimum bit, it is possible to readily increase the number of gray-scale levels. However, in the gray-scale display method in FIG. 9, the number of gray-scale levels is restricted by the number of scan lines. Therefore, it may be possible that the number of scan lines has to be increased in order to increase the number of gray-scale levels.

In the present embodiment, on the other hand, scan lines whose number is less by one than the number of the subfields included in the relevant subblock are selected on a subblock by subblock basis, and one of the selected scan lines is again selected during the same subblock period. This configuration enables, with a period length shorter than that of the subblock, switching to ON-OFF driving commensurate with a bit different from a bit corresponding to a subfield immediately prior to the reselection. As a result, without increasing the number of scan lines, the number of gray-scale levels may be increased.

( 2. Modification)

Hereinabove, while the present technology has been described based on the embodiment, the present technology is not limited to the above-mentioned embodiment, and various modifications may be made.

Figure 7:
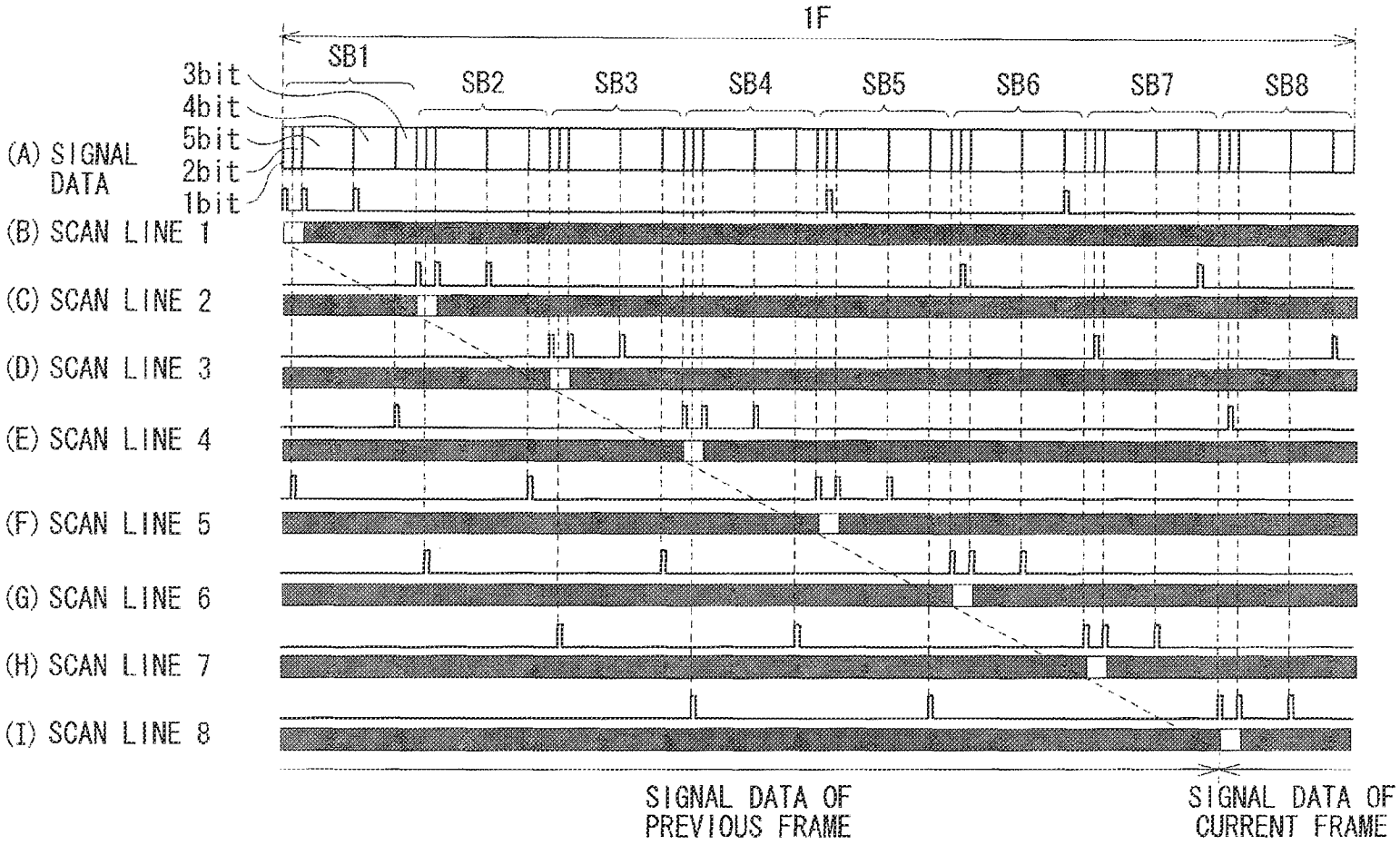
FIG. 7 is a schematic view showing another example of signal data and another example of selection pulses, in one frame period.

For example, while the reselection of the scan line is carried out only once during one subblock period in the above-mentioned embodiment, the reselection of the scan line may be carried out two times during one subblock period as illustrated in FIGS. 7 and 8, for example. In the case where the reselection of the scan line is carried out two times during one subblock period, the number of bit may be increased by two compared to the case where the reselection of the scan line is not carried out.

In addition, while the controller 40 controls the driving of the conversion circuit 30, the vertical driving circuit 50, and the horizontal driving circuit 60 in the above-mentioned embodiment and so forth, other circuits may control the driving. In addition, the control of the conversion circuit 30, the vertical driving circuit 50, and the horizontal driving circuit 60 may be performed by hardware (circuit) as well as by software (program).

Note that the technology may be configured as follows.

(1) A driving circuit configured to drive pixels each including an electro-optical device and a memory in a display in which the pixels are disposed in matrix and a scan line is provided for each of pixel rows, the driving circuit including:

a dividing section dividing one frame period into a plurality of subblocks composed of a plurality of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of the pixel into an on state or an off state according to a corresponding bit in each of the subfields, wherein on a subblock by subblock basis, the ON-OFF period control section selects scan lines whose number is less by one than a number of the subfields included in a relevant subblock, and again selects one of the selected scan lines during a same subblock period.

(2) The driving circuit according to (1), wherein, upon the reselection of one of the selected scan lines during the same subblock period, the ON-OFF period control section writes a bit different from an initial bit in a pixel.

(3) A display including a display region in which pixels each including an electro-optical device and a memory are disposed in matrix and a scan line is provided for each of pixel rows, and a driving circuit configured to drive the pixels, the driving circuit including:

a dividing section dividing one frame period into a plurality of subblocks composed of a plurality of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of the pixel into an on state or an off state according to a corresponding bit in each of the subfields, wherein on a subblock by subblock basis, the ON-OFF period control section selects scan lines whose number is less by one than a number of the subfields included in a relevant subblock, and again selects one of the selected scan lines during a same subblock period.

(4) A method of driving a display in which pixels each including an electro-optical device and a memory are disposed in matrix and a scan line is provided for each of pixel rows, the method including:

dividing one frame period into a plurality of subblocks composed of a plurality of subfields, the subfields corresponding to respective bits of gray-scale data and having period lengths commensurate with weights of the corresponding bits; and controlling a ratio of an ON period or an OFF period to one frame period by bringing an electro-optical device of the pixel into an on state or an off state according to a corresponding bit in each of the subfields, wherein when the ratio of the ON period or the OFF period to one frame period is controlled, scan lines whose number is less by one than a number of the subfields included in a relevant subblock are selected, and one of the selected scan lines is again selected during a same subblock period on a subblock by subblock basis.

The present disclosure contains subject matter related to that disclosed in Japanese Priority Patent Application JP 2011-189927 filed in the Japan Patent Office on Aug. 31, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A driving circuit configured to drive pixels each including an electro-optical device and a memory in a display in which the pixels are disposed in matrix and a scan line is provided for each of pixel rows, the driving circuit comprising:

a dividing section dividing one frame period into a plurality of subblocks composed of a plurality of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of a corresponding pixel into an on state or an off state according to a corresponding bit in each of the subfields, wherein on a subblock by subblock basis, the ON-OFF period control section selects a number of scan lines whose number is less by one than a number of the subfields during a subblock period of a respective subblock, and reselects exactly one of the selected scan lines during the subblock period, and the subblock period is a period of time for the entire subblock.

2. The driving circuit according to claim 1, wherein, upon the reselection of the exactly one of the selected scan lines during the subblock period, the ON-OFF period control section writes a bit different from an initial bit in a pixel.

3. The driving circuit according to claim 1, wherein respective subblocks have period lengths the same as one another.

4. The driving circuit according to claim 1, wherein the frame period is a display frame period.

5. The driving circuit according to claim 1, wherein the subfields are ordered such that the subfield corresponding to the bit having the largest weight occurs second-to-last within the subblock.

6. The driving circuit according to claim 1, wherein the number of subfields included in the respective subblock corresponds to a number of different gray-scale levels which can be displayed by a respective pixel.

7. The driving circuit according to claim 1, wherein the timing of the reselection of the exactly one of the selected scan lines coincides with the start timing of the subfield having greatest weight.

8. A display including a display region in which pixels each including an electro-optical device and a memory are disposed in matrix and a scan line is provided for each of pixel rows; and a driving circuit configured to drive the pixels, the driving circuit comprising:

a dividing section dividing one frame period into a plurality of subblocks composed of a plurality of subfields, the subfields corresponding to respective bits of gray-scale data and having period lengths commensurate with weights of the corresponding bits; and an ON-OFF period control section controlling a ratio of an ON period or an OFF period to one frame period by bringing an electro-optical device of a corresponding pixel into an on state or an off state according to a corresponding bit in each of the subfields, wherein on a subblock by subblock basis, the ON-OFF period control section selects a number of scan lines whose number is less by one than a number of the subfields during a subblock period of a respective subblock, and reselects exactly one of the selected scan lines during the subblock period, and the subblock period is a period of time for the entire subblock.

9. The display according to claim 8, wherein, upon the reselection of the exactly one of the selected scan lines during the subblock period, the ON-OFF period control section writes a bit different from an initial bit in a pixel.

10. The display according to claim 8, wherein respective subblocks have period lengths the same as one another.

11. The display according to claim 8, wherein the frame period is a display frame period.

12. The display according to claim 8, wherein the subfields are ordered such that the subfield corresponding to the bit having the largest weight occurs second-to-last within the subblock.

13. The display according to claim 8, wherein the number of subfields included in the respective subblock corresponds to a number of different gray-scale levels which can be displayed by a respective pixel.

14. A method of driving a display in which pixels each including an electro-optical device and a memory are disposed in matrix and a scan line is provided for each of pixel rows, the method comprising:

dividing one frame period into a plurality of subblocks composed of a plurality of subfields, the subfields corresponding to respective bits of gray-scale data and having period lengths commensurate with weights of the corresponding bits; and controlling a ratio of an ON period or an OFF period to one frame period by bringing an electro-optical device of a corresponding pixel into an on state or an off state according to a corresponding bit in each of the subfields, wherein when the ratio of the ON period or the OFF period to one frame period is controlled, a number of scan lines whose number is less by one than a number of the subfields during a subblock period of a respective subblock are selected, and exactly one of the selected scan lines is reselected during the subblock period on a subblock by subblock basis, and the subblock period is a period of time for the entire subblock.

15. The method of driving a display according to claim 14, wherein, upon the reselection of the exactly one of the selected scan lines during the subblock period, the ON-OFF period control section writes a bit different from an initial bit in a pixel.

16. The method of driving a display according to claim 14, wherein respective subblocks have period lengths the same as one another.

17. The method of driving a display according to claim 14, wherein the frame period is a display frame period.

18. The method of driving a display according to claim 14, wherein the subfields are ordered such that the subfield corresponding to the bit having the largest weight occurs second-to-last within the subblock.

19. The method of driving a display according to claim 14, wherein the number of subfields included in the respective subblock corresponds to a number of different gray-scale levels which can be displayed by a respective pixel.

20. The display according to claim 14, wherein the timing of the reselection of the exactly one of the selected scan lines coincides with the start timing of the subfield having greatest weight.

21. The method of driving a display according to claim 14, wherein the timing of the reselection of the exactly one of the selected scan lines coincides with the start timing of the subfield having greatest weight.

22. A driving circuit configured to drive pixels each including an electro-optical device and a memory in a display in which the pixels are disposed in matrix and a scan line is provided for each of pixel rows, the driving circuit comprising:

a dividing section dividing one frame period into a plurality of subblocks that are each composed of N subfields, where N is a number bits making up each instance of gray-scale data for driving the pixels, each of the subfields corresponds to one of the bits, and a period length of each subfield is commensurate with a weight of its corresponding bits; and an ON-OFF period control section controlling a ratio of an ON period or an OFF period to one frame period by bringing an electro-optical device of a corresponding pixel into an on state or an off state according to a corresponding bit in each of the subfields, wherein on a subblock by subblock basis, the ON-OFF period control section selects exactly N−1 distinct scan lines during the subblock period, with exactly one of the N−1 distinct scan lines being selected more than once during the subblock period, and the subblock period is a period of time for the entire subblock.

* * * * *